United States Patent [19]

Pastva

[11] 4,146,257

[45] Mar. 27, 1979

[54] CLOSURE CONTROL MECHANISM

[75] Inventor: John V. Pastva, Parma Heights, Ohio

[73] Assignee: The Eastern Company, Naugatuck, Conn.

[21] Appl. No.: 777,003

[22] Filed: Mar. 14, 1977

[51] Int. Cl.[2] ..... E05C 3/08

[52] U.S. Cl. ..... 292/218

[58] Field of Search ..... 292/218, 304, 213, 241, 292/101, 103, 202, 204

[56] References Cited

U.S. PATENT DOCUMENTS

| | | | |
|---|---|---|---|
| 538,512 | 4/1895 | Grodavent | 292/241 |
| 2,402,241 | 6/1946 | Dath | 292/218 |
| 3,695,661 | 10/1972 | Pastva | 292/218 |
| 4,057,273 | 11/1977 | Carr | 292/218 |

*Primary Examiner*—Richard E. Moore

*Attorney, Agent, or Firm*—Watts, Hoffmann, Fisher & Heinke, Co.

[57] ABSTRACT

A low silhouette closure control mechanism especially designed for a swinging or pivoted door of a highway vehicle, such as, a truck or trailer. The mechanism includes a plurality of cam-type latch or bolt members welded to an elongated shallow channel member and suitably spaced therealong. The channel member is rotatably connected by pintle pins to hinge members fixed to the pivoted closure or door adjacent to its non-pivoted or free edge, that is, the edge of the door remote from the edge hinged to the door frame of the vehicle body. The latch members connected to the channel member cooperate with discrete keeper members connected to the adjacent side of the door frame or to the adjacent side of the second door if employed with double doors. The pivotal axis for the channel member which carries the latch members is located at or substantially at the free edge of the door thus locating it close to the keeper members. A handle is connected to the channel member for rotating the same to engage and disengage the latch members with their respective keeper members. Modified latch and keeper members are constructed to provide an anti-rack capability.

15 Claims, 9 Drawing Figures

CLOSURE CONTROL MECHANISM

BACKGROUND OF THE INVENTION

1. Field of the Invention

Swinging cam-bolt type closure control mechanism.

2. Description of the Prior Art

This invention relates to a closure control mechanism of the cam-bolt latch and keeper type for use with a pivoted door, especially a door of a truck, truck trailer or like highway vehicle.

Many highway trucks, truck trailers and like vehicles, and also non-highway vehicles, typically have pivoted doors through which loading and unloading of the vehicle is accomplished. A lack of cross-bracing at the door opening permits distortion of the vehicle body including the door frame when subject to uneven support or load-induced stresses. Prior cam-bolt type closure control mechanisms used with pivoted doors of trucks and like vehicles have a relatively high silhouette thus reducing the usable inside space, have their pivot axis relatively far from the keepers etc. and do not normally adequately reinforce the door and door frame and thus do not prevent distortion of the door frame and in turn distortion of the body of the vehicle by load and terrain induced stresses.

SUMMARY OF THE INVENTION

The present invention provides novel and improved cam-bolt type closure control mechanism especially designed for use with a pivoted door of a truck-type vehicle which has a relatively low silhouette, is rugged in construction, reinforces the closure member or door to which it is applied, is capable of tightly closing or so maintaining the door in closed position as the axis for the bolt or bolts is at or relatively close to the free edge of the door, and when the door is closed it in affect becomes a part of and thus reinforces the body of the vehicle. The mechanism includes an elongated relatively flat plate-like or channel member, preferrably of a length equal to or greater than that of the non-pivoted or free edge of the closure member or door, adapted to be pivotally connected by at least one hinge member or assembly adapted to the free edge of a pivoted closure member or door with its pivotal axis at or closely adjacent to the free edge of the closure member door and reinforce the same. One or more keeper members are provided having a base part adapted to be secured to a part of the vehicle adjacent to the non-pivoted edge of the door and a part spaced from the base part providing a surface spaced from and facing the base part for selective engagement by a latch member fixed to the plate-like member. The latch member or members comprise body parts formed integral with or fixedly connected to the plate-like member and cam parts extending beyond the plate-like member for cooperation with the surfaces on the keeper member or members facing the base part or parts thereof to secure the closure member door in closed condition. A handle member connected to the plate-like member is provided for rotating the plate-like member to engage and disengage the latch and keeper members with one another.

The invention further provides novel and improved closure control mechanism of the character referred to above having further anti-rack capabilities incorporated in the cooperating latch and keeper members in the form of cooperating surfaces on the latch and keeper members generally normal to the plane of the door with which the control mechanism is employed and converging in the direction towards the closure member or door. These surfaces on the respective keeper members may diverge from one another in the direction away from the body of the vehicle or other device with which the closure member is used.

When further members are provided and adapted to extend beyond one or both ends of the non-pivoted side of the closure member or door which members may be part of the hinge member or assembly and/or the plate-like member mentioned above extended beyond one or both ends of the non-pivoted side of the door, the invention provides novel and improved closure control mechanism of the character referred to having additional anti-rack capabilities which may take the form of apertures in the parts extending beyond the upper and lower edges of the vehicle door which apertures are adapted to receive and fit without play or unnecessary loseness auxiliary keepers or projecting members on the vehicle body at the upper and/or lower edges of the door.

The low silhouette of the closure control mechanism of the present invention is particularly advantageous when the mechanism is used with a side door of a highway truck-type vehicle.

When the closure control mechanism of the invention is to be used with double doors a zero torque capability can be readily incorporated therein.

Further advantages and improved features of the closure control mechanism of the present invention will be hereinafter referred to or will be apparent from the drawings and description of the preferred embodiment of the invention.

Figures 1, 2:
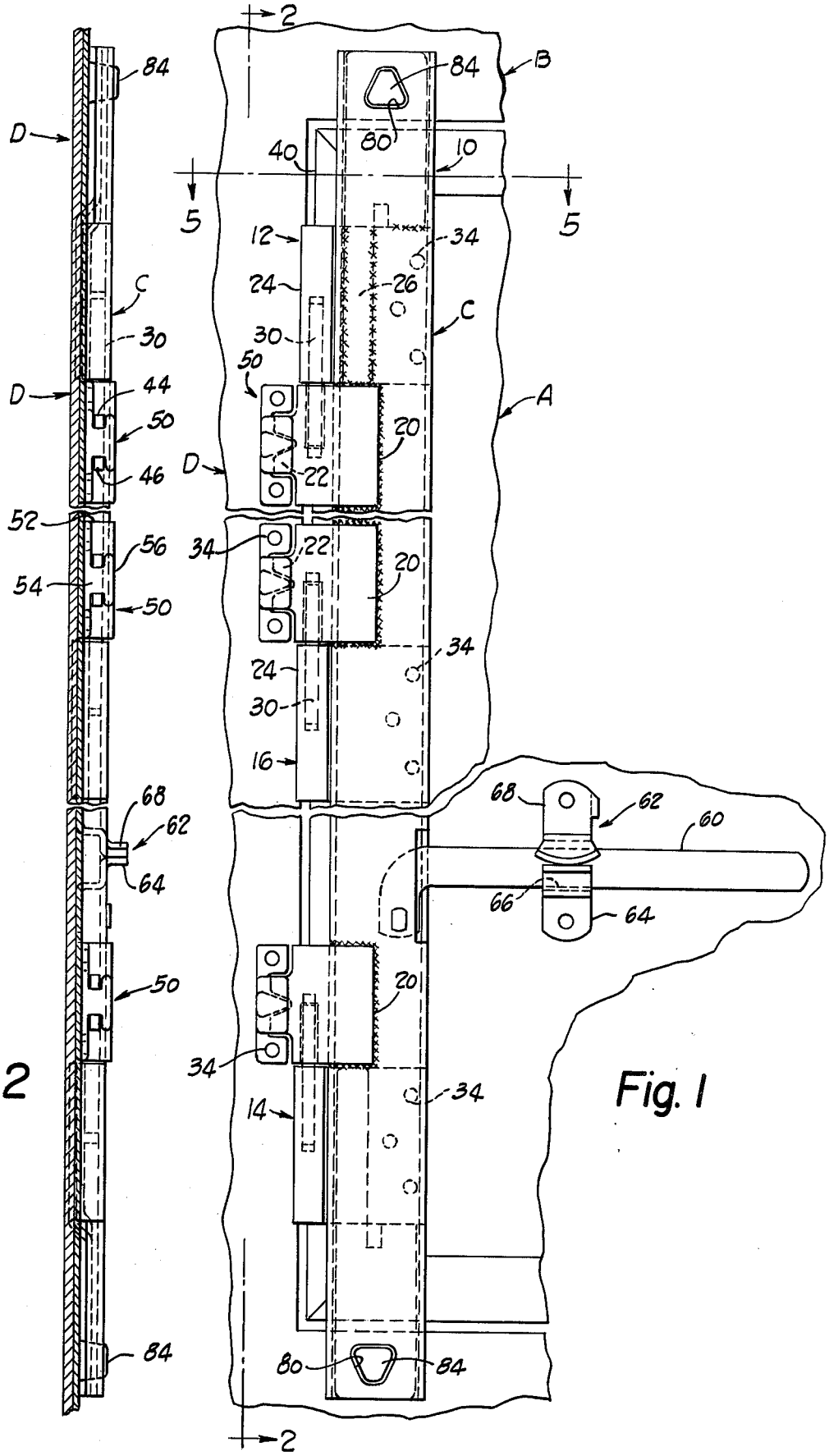
FIG. 1 is a fragmentary elevational view of one side of a highway truck-type trailer showing a preferred embodiment of the closure control mechanism of the present invention applied to a recessed side door of the trailer.
FIG. 2 is a fragmentary sectional view approximately on the line 2—2 of FIG. 1.
Figure 3:
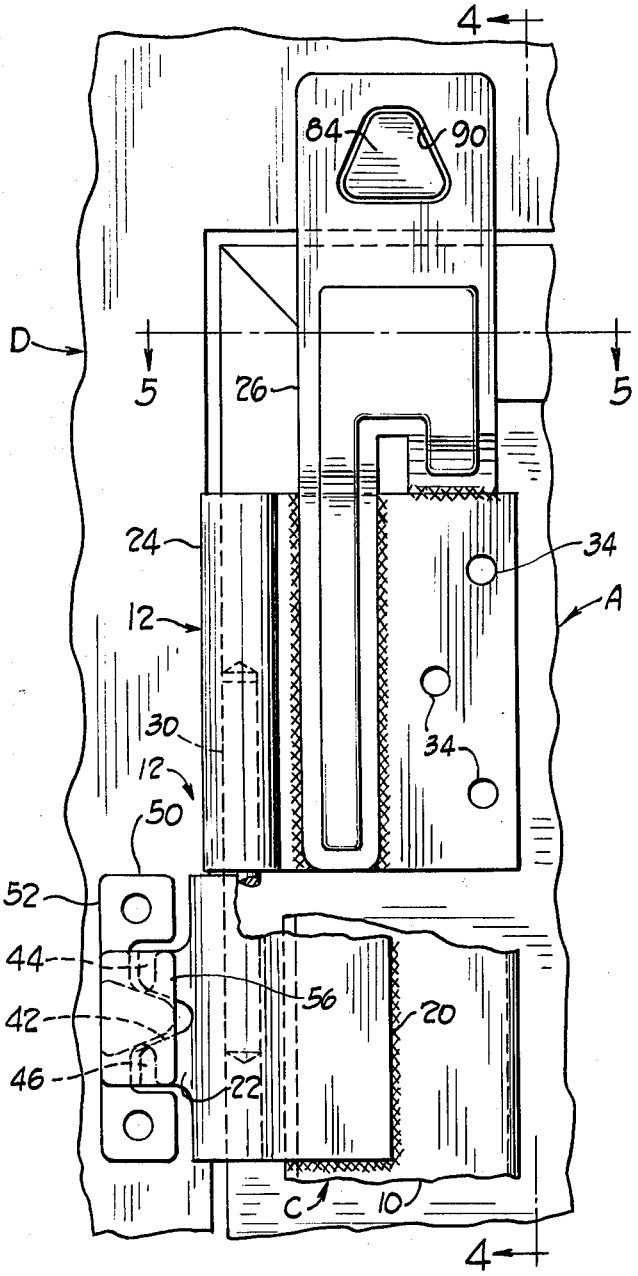
FIG. 3 is a fragmentary enlarged view of a portion of FIG. 1 with parts broken away.
Figure 4:
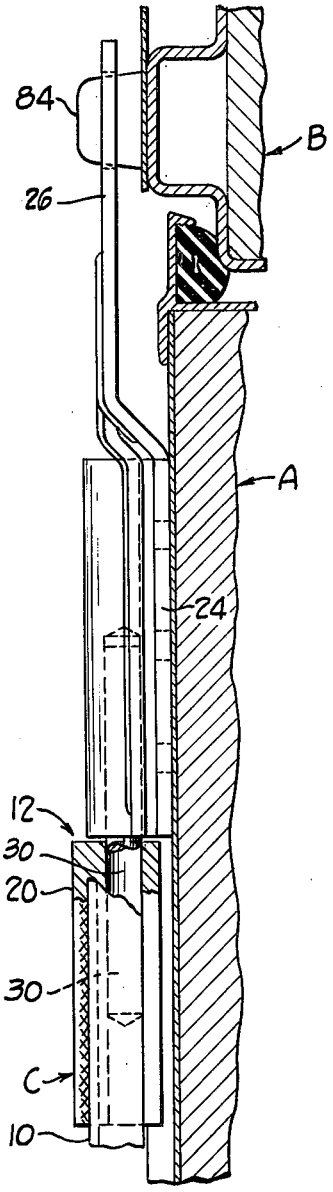
FIG. 4 is a fragmentary sectional view approximately on the line 4—4 of FIG. 3.
Figure 5:
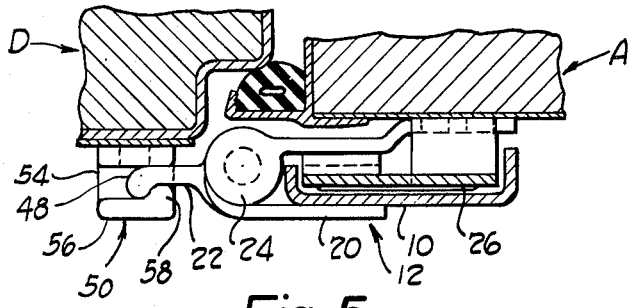
FIG. 5 is a fragmentary sectional view approximately on the line 5—5 of FIGS. 1 and 3.

A preferred embodiment of the closure control mechanism of the present invention, illustrated in FIGS. 1 to 5 of the drawings, is used to secure a recessed side door A of a truck trailer B in closed position. The closure mechanism per se is designated generally by the reference character C. The door A is hinged to the door frame D of the trailer body by hinges, not shown, along the right-hand vertical edge of the door A as viewed in FIG. 1. The door control mechanism includes an elongated plate-like channel member 10 pivotally connected to the door A along the non-pivoted or free edge door by a plurality of hinge assemblies, preferrably five or more two of which are typically located adjacent to the upper and lower edges of the door. In the embodiment illustrated three hinge assemblies are shown designated 12, 14, 16. Hinge assemblies 12, 14 are located adjacent to the upper and lower edges of the door, respectively. Hinge assembly 16 is located between assemblies 12, 14. In addition to the typical hinge parts 20, 24 connected by a pintle pin 30 the hinge parts 20 have cam-bolt type latch parts or member 22 formed integral therewith and the hinge parts 24 of the top and bottom hinge assemblies have anti-rack parts of brackets 26 welded thereto. Aside from the fact that the combined hinge and latch parts 20, 22 are below the hinge part 24 of the upper hinge assembly, and in the other hinge assemblies the reverse is true, the hinge assemblies are essentially alike and the corresponding parts of the various assemblies, although not necessarily duplicates of one another, are designated by the same reference characters.

The hinge parts 20 of the combination hinge and latch members are welded to the web of the plate-like channel member 10 and the hinge parts 24 of the combination hinge and anti-rack brackets and the hinge part 24 of the hinge device 16 are riveted to the door A as by rivets 34. The cam latch parts 22 of the closure mechanism extend beyond the vertical free edge 40 of the door have V-shaped notches 42 in their projecting sides forming spaced tines 44, 46 the projecting ends of which are enlarged to provide projections 48 extending outwardly with reference to the plane of the web of the channel member 10. The cam or latch parts 22 of each of the combination hinge and cam members of the hinge devices 12, 14, 16 engage with discrete keeper members 50 connected to the door frame D opposite the side to which the door A is hinged to secure the door in closed position.

Each of the keeper members 50 comprises a base part 52 by which the keeper member is secured to the door frame as by rivets 34, a stem-like projecting part 54 extending from the base part 52 in the direction away from the body of the vehicle and a part 56 at the end of the stem part 54 extending transversely of the stem providing surfaces on the side thereof spaced from but facing in the direction of the base part 52. The transversely extending part of the keeper member 50 has a flange or flanges 58 on the side thereof facing the base part 52 along the edge adjacent to the door opening for engagement in the channel in the cam part 22 formed by the enlargements 48, previously mentioned, on the ends of the tines 44, 46 of the latch members 22 when the closure control mechanism is in door securing position.

In the embodiment depicted, the sides of the V-notches 42 in the latch parts 22 converge in the direction towards the hinge parts thereof and when the closure control mechanism is in door securing position the tines 44, 46 straddle and engage without looseness or play the stem or projecting part 54 of its cooperating keeper 50, the sides of which part preferably converge in a manner complementary to the sides of the V-notches. The sides of the V-notches 42 in the latch members and the adjacent sides of the projecting or post-like parts 54 of the keeper members 50 may be made to diverge slightly in the direction towards the outside of the vehicle body if this is considered advisable.

The member 10 is provided with a handle member 60 lying generally in the plane of the web of the member 10 and pivotally connected thereto for rotation about an axis normal to the plane of the web of the member. The handle member 60 is adapted to be held and locked with a key lock in a position adjacent to the outside of the door A to secure the door in closed position by conventional mechanism designated 62 suitably mounted on the door A. The mechanism 62 includes a part 64 providing a recess 66 for the handle 60 and a pivoted member or pawl 68 for releasably retaining the handle in the recess 66. The member 68 can be secured to the member 64 by a key lock.

The member 10 preferrably extends beyond the top and bottom edges of the door A and each extension is provided with an aperture 80, which in the preferred construction has a configuration of an isosceles triangle with its apex located outwardly of the door and its sides preferrably diverging in the direction of the inside of the vehicle. The apertures 80 are adapted to receive tapered posts or auxiliary keeper members 84 the base parts of which are welded or otherwise suitably secured to the door frame at the top and bottom of the door A. The cross-sectional shape of the members 84 is like that of the apertures 80 and when the door A is closed and latched the auxiliary keeper members 84 fit without play in the apertures 80 thereby preventing relative shifting of the door A and truck body in the plane of the door thus providing anti-rack capabilities.

As previously mentioned the upper and lower hinge devices or assemblies 12, 14 each include a hinge part 24 and anti-rack bracket 26. The hinge part 24 includes a plate-like section having two portions offset from one another with respect to the plane of the door and the anti-rack brackets 26 are members welded to the hinge parts 24 and extending above and below the upper and lower ends of the door A. The projecting end of each of the bracket parts 26 is provided with an aperture 90 similar to but slightly larger than the apertures 80 in the projecting ends of the member 10 and when the door A is closed the auxiliary keepers 84 project through the apertures 90 within which they are received without looseness or play thus producing a still further anti-rack capability.

When it is desired to close a door A of a vehicle to which the closure mechanism C is applied, the member 10 is positioned, preferrably at or about at right angles or normal to the plane of the door, if it is not already in this position. The door is then closed engaging the auxilliary keeper members 80 at the top and bottom of the door in the apertues 90 of the bracket members 26. The member 10 is subsequently rotated in a counter-clockwise direction as viewed in FIG. 5 into a position parallel with the plane of the door which is the position shown in the drawings thereby projecting the forks or tines 44, 46 of the lack members 22 underneath the transverse parts 56 of the keeper members 50 with which they cooperate. The engagement of the parts 44, 46 of the latch members 22 with the surfaces underneath the transverse parts 56 of the keeper members during rotation of the member 10 as mentioned above cams the door into tightly closed position. This also produces tight engagement of the auxilliary or secondary keeper members 84 in the apertures 80, 90 in the members 10, 26. Simultaneously the side surfaces of the notches 42 in the latch members 22 are moved into firm contact with the side surfaces of the post parts 54 of the cooperating keeper members 50 to further assist in preventing racking. The engagement of the projections 48 on the ends of the times of the latch members 22 about the flanges 58 on the underside of the transverse member 56 of the keeper members 50 enhances the aforementioned door securing and non-racking capability of the mechanism C.

Figure 7:
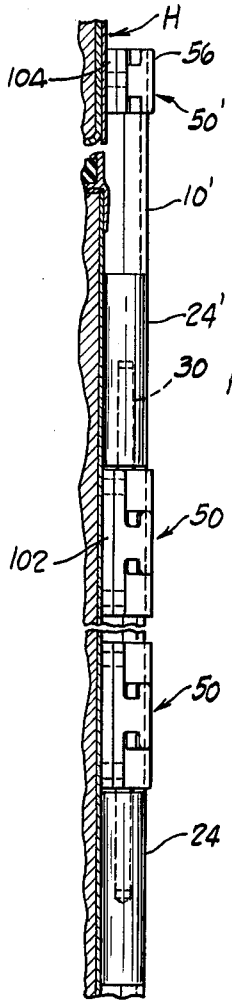
FIG. 7 is a fragmentary sectional view approximately on the line 7—7 of FIG. 6.
Figure 6:
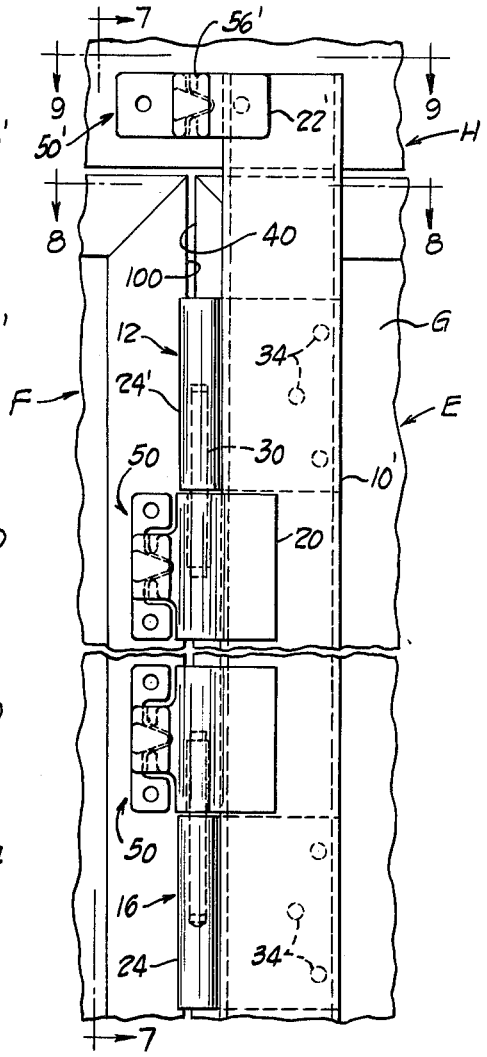
FIG. 6 is a fragmentary elevational view of the rear of a highway type truck trailer showing the closure control mechanism of the present invention applied to rear double doors of the trailer.
Figure 8:
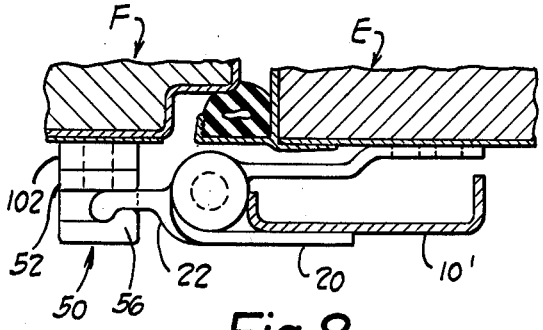
FIG. 8 is a fragmentary sectional view approximately on the line 8—8 of FIG. 6.
Figure 9:
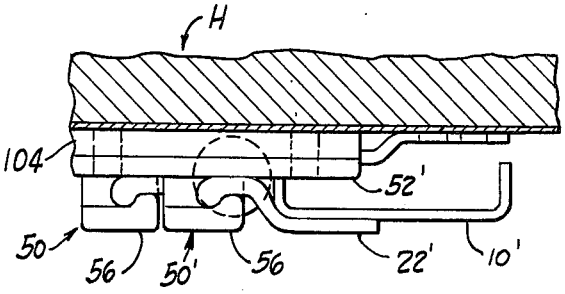
FIG. 9 is a fragmentary sectional view approximately on the line 9—9 of FIG. 6.

The embodiment of the closure control mechanism of the present invention illustrated in FIGS. 6 to 9 of the drawings illustrates how the closure control mechanism might be used to secure a pair of rear door E, F of a track trailer in closed position and incorporates a zero-torque capability, that is, force applied to a door equipped with the depicted mechanism in a direction to open the door does not tend to release the closure mechanism. Most of the parts of the closure control mechanism shown in FIGS. 6 to 9 are duplicates of those in FIGS. 1 to 5 and previously described and are not hereinafter redescribed but are designated by the same reference characters and corresponding but modified parts by the same reference characters with a prime mark affixed thereto.

The closure mechanism per se shown in FIGS. 6 to 9 is designated generally by the reference character G. The right and left doors E, F are hinged to the door frame H of the vehicle body by hinges, not shown, along the right and left vertical edges of the doors, as viewed in FIG. 6. The control mechanism G includes an elongated plate-like channel member 10' pivotally connected to the door E along the non-pivoted or free edge 40 thereof by hinge devices located adjacent to the upper and lower edges of the door and therebetween. The upper and lower hinge devices each comprise a combination hinge part 20 cam bolt latch part 22 and a hinge part 24'. The anti-ract brackets of the previous embodiment are omitted.

The cam latch parts 22 of the closure mechanism extend beyond the vertical free edge 40 of the door E and engage with a discrete keeper members 50 connected to the door F adjacent its free edge 100. Since the doors E, F are not recessed into the rear of the vehicle B spacers 102 are employed or inserted between the base parts 22 of the keepers 50 and the door F so that the keepers engage properly with the cam latch members 22.

The members 10' extend beyond the top and bottom edges of the door E and the extensions are provided with cam type latch or bolt parts or members 22' similar to the cam latch parts 22 previously described but instead of being a part of a hinge device are discrete members welded to the outer or rear side of the member 10'. The cam latch members 22' engage keeper members 50' similar to the keeper members 50 except that the base part 52' thereof extend transversely of the part 56' rather than lengthwise thereof. The base parts of the keepers 50' are secured to the door frame H adjacent to the upper and lower ends of the free edge of the door E such that the parts 56' thereof are in line lengthwise of the vehicle with the pivoted connection of the member 10' with the door E when the door is in closed position. The construction is such that when the door E is latched closed the engagement between the cam latch 22' and its keeper 50' is in the plane normal to the plane of the door E and in which plane lies the axis of the pivotal connection of the member 10' to the door, thereby avoiding any tendency of the member 10' to pivot about it connection with the door E by a force applied to the inside of the door as by a load shift to the rear of the vehicle. A spacer 104 is employed underneath each of the keepr members 50' for the same reasons that the spacers 102 are employed underneath the keepers 50.

From the foregoing description of preferred embodiments of the invention it will be apparent that the objects heretofore mentioned have been accomplished and that there has been provided a novel and improved closure control mechanism especially adapted for use with pivoted doors of highway vehicles which not only reinforces the door with which it is used but also securely retains the door in closed position. The reinforced door and its secure connection to the vehicle body in closed position reinforces the body of the vehicles and prevents racking, that is, relative movement between the door and vehicle body in the plane of the door. The door and vehicle body in effect become a unitary structure.

What is claimed is:

1. A mechanism for securing a pivoted first member to a second member, such as, a side door of a highway truck type vehicle to an adjacent door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to a second member adjacent to the non-pivoted edge of the first member for rotation of said plate-like member about an axis adjacent to the free edge of the first member, that is, the edge of the first member remote from the pivoted edge of the first member; a member connected to said plate-like member for rotating said plate-like member about its pivotal connection with said one member; a keeper member having a base part adapted to be secured to a second member adjacent to the free edge of the first member and providing a surface spaced from said base part and facing in the direction of said base part; and said plate-like member having a cam type latch part at the side of said axis opposite to the longitudinal centerline of said plate-like member for cooperation with said surface on said keeper member to secure the first member to the second member.

2. A mechanism for securing in closed position a pivoted member, such as, a door of a highway truck type vehicle, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured in closed position adjacent to the non-pivoted edge of the first member for rotation of said plate-like member about an axis adjacent to the free edge thereof, that is, the edge of the first member remote from the pivoted edge of the first member; a member connected to said plate-like member for rotating said plate-like member about its pivotal connection with said one member; a keeper member having a base part adapted to be secured to a second member adjacent to the free edge of the first member and providing a surface spaced from said base part and facing in the direction thereof and surfaces facing away from one another between said base part and said surface spaced from said base part; and said plate like member having a cam type part at the side of said axis opposite to the longitudinal center line of said plate-like member and an aperture in the projecting part thereof providing surfaces for cooperation with said surface on said keeper member facing in the direction of said base part of said keeper member and an aperture forming surfaces for cooperation with said surfaces between said base part and said surface spaced from said base part to secure the first member in closed condition.

3. A mechanism for securing in closed position a pivoted member, such as, a door of a highway truck type vechicle, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured in a closed position adjacent to the non-pivoted edge of the first member for rotation of said plate-like member about an axis adjacent to the free edge of the first member; a member connected to said plate-like member for rotating said member about its pivotal connection with said one member; a keeper member having a base part adapted to be secured to a second member adjacent to the free edge of the first member and a part projecting from said base part having a transversely extending part of the projecting end thereof providing a surface spaced from said base part and facing in the direction thereof; and said plate-like member having a cam type latch part at the side of said axis opposite to the longitudinal centerline of said plate-like member and extending therefrom with a V-notch in the projecting side thereof forming forked parts for cooperation with said surface on said transversely extending part of said keeper member with said part projecting from said base part of said keeper member to secure the first member to the second member and to prevent relative movement between the first and second members in the plane of the first member and lengthwise of the length of said plate-like member.

4. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivioted first member to be secured to the second member adjacent to the non-pivoted edge of the first member for rotation of said plate-like member about an axis adjacent to the free edge of the first member and with one end of said one member extending beyond an end of the first member and having an aperture in its extending end opening at least into the side thereof facing in the direction of the first member; a member connected to said plate-like member for rotating said plate-like member about its pivotal connection with said one member; a first keeper member having a base part adapted to be secured to the second member adjacent to the non-pivoted edge of the first member and providing a surface spaced from said base part and facing in the direction of said base part; said plate-like member having a cam type latch part extending from the side thereof opposite said axis from the center-line of said plate-like member for cooperation with said surface on said first keeper member to secure the first member to the second member; and a second keeper member adapted to be secured to a part of the second member adjacent to an end of the first member when in secured position to project from the second member and to be received in said aperture in said one member to prevent relative movement between the first and second members in the plate of the first member.

5. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to a second member adjacent to the non-pivoted edge of the first member for rotation of said plate-like member about an axis adjacent to the free edge of the first member and extend beyond at least one end of the first member and having an aperture in its extending end opening at least into the side thereof facing in the direction of the first member; a member connected to said plate-like member for rotating said plate-like member about its pivotal connection with said one member; a first keeper member having a base part adapted to be secured to the second member adjacent to the non-pivoted edge of the first member and providing a surface spaced from said base part and facing in the direction of said base part; said plate-like member having a cam type latch part extending from the side thereof opposite to said axis from the longitudinal centerline of said plate-like member for cooperation with said surface on said first keeper member to secure the first member to the second member; a further member adapted to be connected to the same side of the pivoted first member as said plate-like member is adapted to be connected thereto and extend beyond an end of the first member and having an aperture in its extending end; and a second keeper member adapted to be secured to a part of the second member adjacent to an end of the first member when in secured position to project from the second member and to be received in said apertures in said plate-like member and said further member to prevent relative movement between the first and second members in the plane of the first member.

6. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to the second member adjacent to the non-pivoted edge of the first member for rotation of said plate-like member about an axis adjacent to the free edge of the first member and with the ends of said plate-like member extending beyond the ends of the first member and having at least one aperture in each of its extending ends opening at least into the side thereof facing in the direction of a first member; a member connected to said plate-like member for rotating said plate-like member about its pivotal connection with said one member; a plurality of first keeper members each having a base part adapted to be secured to the second member adjacent to the non-pivoted edge of the first member and providing a surface spaced from said base part and facing in the direction of said base part; said plate-like member having a plurality of cam type latch parts extending from the side thereof opposite to said axis from the longitudinal centerline of said plate-like member for cooperation with said surfaces on said first keeper member to secure the first member to the second member; and second keeper members adapted to be secured to a part of the second member adjacent to opposite ends of the first member when in secured position to project from the second member and to be received in said apertures in said elongated plate-like member to prevent relative movement between the first and second members in the plane of the first member.

7. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to the second member adjacent to the non-pivoted edge of the first member for rotation of said plate-like member about an axis adjacent to the free edge of the first member and with the ends of said plate-like member extending beyond both ends of the first member and having at least one aperture in each of its extending ends opening at least into the side thereof facing in the direction of the first member; means for rotating said plate-like member about its pivotal connection with said one member; first keeper means having a base part adapted to be secured to the second member adjacent to the non-pivoted edge of the first member and providing surface means spaced from said base part and facing in the direction thereof; latch means integral with said plate-like member for cooperation with said surface means on said first keeper means to secure the first member to the second member; further members adapted to be connected to the same side of the pivoted first member as said one member is adapted to be connected thereto and extend beyond the ends of the first member and each having an aperture in its extending end; and second keeper members adapted to be secured to a part of the second member adjacent to the ends of the first member when in secured position to project from the second member and to be received in said apertues in said elongated plate-like member and said further members to prevent relative movement between the first and second members in the plane of the first member.

8. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to the second member adjacent to the non-pivoted first member to be secured to the second member adjacent to the non-pivoted edge of the first member for rotation of said plate-like member about an axis adjacent to the free edge of the first member and with the end of said plate-like member extending beyond the ends of the first member and having an aperture in each of its extending ends opening at least into the side thereof facing in the direction of the first member; a member connected to said plate-like member for rotating said plate-like member about its pivotal connection with said one member; a plurality of first keeper members each having a base part adapted to be secured to the second member adjacent to the non-pivoted edge of the first member and a part projecting from said base part and providing a surface spaced from said base part and facing in the direction thereof; a plurality of latch members each having a cam part extending beyond said plate-like member and provided with a V-notch in the projecting side thereof forming forked parts for cooperation with said surfaces on said first keeper members and with said parts projecting from said base parts of said keeper members to secure the first member to the second member; and second keeper members adapted to be secured to a part of the second member adjacent to opposite ends of the first member when in secured position to project from the second member and to be received in said apertures in said elongated plate-like member to prevent relative movement between the first and second members in the plane of the first member.

9. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to the second member adjacent to the non-pivoted edge of the first member for rotation of said plate-like member about an axis adjacent to the free edge of the first member and with the end of said plate-like member extending beyond both ends of the first member and having at least one aperture in each of its extending ends opening at least into the side thereof facing in the direction of the first member; a member connected to said plate-like member for rotating said plate-like member about its pivotal connection with said one member; a plurality of first keeper members each having a base part adapted to be secured to the second member adjacent to the non-pivoted edge of the first member and a part projecting from said base part and providing a surface spaced from said base part and facing in the direction thereof; said plate-like member providing a plurality of cam type latch part extending beyond said plate-like member and each having a V-notch in the projecting side thereof forming forked parts for cooperation with said surface on one of said first keeper members and with said part projecting from said base part of said keeper member to secure the first member to the second member; further members adapted to be connected to the same side of the first member as said one member is adapted to be connected and extend beyond both ends of the first member and each having an aperture in its extending end; and second keeper members adapted to be secured to a part of the second member adjacent to opposite ends of the first member when in secured position to project from the other member and to be received in said apertures in said elongated plate-like member and said further members to prevent relative movement between the first and second members in the plane of the first member.

10. A mechanism for securing a pivoted first member to a second member, such as, a side door of a highway truck type vehicle to an adajcent door and/or a door frame, said mechanism including an elongated plate-like member having at least one member pivotally connected thereto for rotation about an axis extending lengthwise of said plate-like member and offset from the longitudinal center thereof, said one member being adapted to be connected to one side of a pivoted first member to be secured to the second member adjacent to the non-pivoted edge of the first member for rotation of said plate-like member about an axis adjacent to the free edge of the first member, that is, the edge of the first member remoted from the pivoted edge of the first member and extend beyond at last one end of the first member; means for rotating said plate-like member about its pivotal axis with said one member; a keeper member having a base part adapted to be secured to the second member adjacent to one end of the free edge of the first member and a part projecting from said base part and providing a surface spaced from said base part facing in the direction of said base part and in a plane normal to the plane of the first member when the first member is in closed position and in which plane lies the axis of the pivotal connection of said plate-like member with said one member when the first member is in closed position; and integral with said extension of said plate-like member and an integral cam part for cooperation with said surface on said keeper member to secure the first member to the second member.

11. A mechanism for securing in closed position a pivoted member, such as, a door of a highway truck type vehicle, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured in closed position adjavent to the non-pivoted edge of the first member for rotation of said plate-like member about an axis adjacent to the free edge thereof, that is, the edge of the first member remote from the pivot edge of the first member and extend beyond at least one end of the first member; means for rotating said plate-like member about its pivotal connection with said one member; a first keeper member having a base part adapted to be secured to a second member adjacent to the free edge of the first member and a part projecting from said base part providing a surface spaced from said base part and facing in the direction thereof; said plate-like member providing a cam type latch part projecting from the side of said plate-like member opposite to said axis from said longitudinal centerline of said plate-like member for cooperation with said surface on said first keeper member to secure the first member in closed condition; a second keeper having a base part adapted to be secured to the second member adjacent to one end of the free edge of the first member and a part projecting from said base part providing a surface spaced from said base part in the plane normal to the plane of the first member when the first member is in closed position and in which plane lies the pivotal axis of the pivotal connection of said plate-like member with said one member when the first member is in closed position; and a second latch member comprising a body part integral with said extension of said plate-like member and an integral cam part in line with the axis of the pivotal connection of said plate-like member for cooperation with said surface on said second keeper to further secure said first member in closed position.

12. A mechanism for securing in closed position a pivoted member, such as, a door of a highway truck type vehicle, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured in a closed position adjacent to the non-pivoted edge of the first member for rotation of said plate-like member about an axis adjacent to the free edge of the first member and extend beyond at least one end of the first member; means for rotating said member about its pivotal axis; a first keeper member having a base part adapted to be secured to a second member adjacent to the free edge of the first member and a part projecting from said base part having a transversely extending part on the projecting end thereof providing a surface spaced from said base part and facing in the direction thereof; a second keeper member similar to said first keeper member adapted to be secured to the second member adjacent to one end of the free edge of the first member with the surface thereof facing in the direction of the base part and in the plane normal to the plane of the first member when the first member is in closed position and in which plane lies the axes of the pivotal connection of said plate-like member with said one member when the first member is in closed position; said plate-like member having a cam type latch projecting from the side of said plate-like member opposite to said axis from said longitudinal centerline of said plate-like member and having a V-notch in the projecting side thereof forming forked parts for cooperation with said surface on said transversely extending part of said first keeper member and with said part projecting from said base part of said first keeper member to secure the first member to the second member and to prevent relative movement between the first and second members in the plane of the first member and lengthwise of the length of said plate-like member; and a second latch member similar to said first latch member fixed to said extension of said plate-like member with the cam part thereof in the plane normal to the plane of the first member when the first member is in closed position and in which plane lies the axis of the pivotal connection of said plate-like member with said one member when the first member is in closed position to further secure the first member in closed position and prevent relative movement between the first and/or second members in the plane of the first member and lengthwise of the length of said plate-like member.

13. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to a second member adjacent to the non-pivoted edge of the first member for rotation of said plate-like member about an axis adjacent to the free edge of the first member; a member connected to said plate-like member for rotating said plate-like member about its pivotal connection with said one member; a first keeper member having a base part adapted to be secured to the second member adjacent to the non-pivoted edge of the first member and a part projecting from said base part and providing a surface spaced from said base part and facing in the direction thereof; said plate-like member comprising latch means for cooperation with said surface on said first keeper member to secure the first member to the second member; a further member adapted to be connected to the same side of the pivoted first member as said plate-like member is adapted to be connected and extend beyond an end of the first member and having an aperture in its extending end; and a second keeper member adapted to be secured to a part of the second member adjacent to an end of the first member when in secured position to project from the second member and to be received in said aperture in said further member to prevent relative movement between the first and second members in the plane of the first member.

14. A mechanism for securing a pivoted first member to a second member, such as, a door of a highway truck type vehicle to a second door and/or a door frame, said mechanism including attachment means pivotally connected to an elongated plate-like member for rotation about an axis extending lengthwise of said plate-like member and offset from the longitudinal center thereof, said attachment means adapted to be connected to one side of a pivoted first member to be secured to the second member adjacent to the non-pivoted edge of the first member for rotation of said plate-like member about an axis adjacent to the free edge of the first member and with said attachment means extending beyond each end of the first member and having an aperture in each of its extending ends opening at least into the side thereof facing in the direction of the first member; means for rotating said plate-like member about its pivotal connection with said one member; a first keeper member having a base part adapted to be secured to the second member adjacent to the non-pivoted edge of the first member and a part projecting from said base part and providing a surface spaced from said base part and facing in the direction thereof; said plate-like member providing a cam type latch part extending from the side of said plate-like member opposite to said axis from said centerline of said plate-like member for cooperation with said surface on said first keeper member to secure the first member to the second member; and second keeper members adapted to be secured to a part of the second member adjacent to both ends of the first member when in secured position to project from the second member and to be received in said apertures in said attachment means to prevent relative movement between the first and second members in the plane of the first member.

15. A mechanism for securing a pivoted first member to a second member, such as, a door of a highway truck type vehicle to a second door and/or a door frame, said mechanism including an elongated plate-like member pivotally connected to at least one member for rotation about an axis extending lengthwise of said plate-like member and offset from the longitudinal center thereof, said one member being adapted to be connected to one side of a pivoted first member to be secured to a second member adjacent to the non-pivoted edge of the first member for rotation of said plate-like member about an axis adjacent to the free edge of the first member and extend beyond at least one end of the first member and having an aperture in its extending end opening at least into the side thereof facing in the direction of the first member; a member connected to said plate-like member for rotating said plate-like member about its pivotal connection with said one member; a first keeper member having a base part adapted to be secured to the second member adjacent to the non-pivoted edge of the first member and a part projecting from said base part and providing a surface spaced from said base part and facing in the direction thereof; said plate-like member having a cam type latch part extending from the side thereof opposite to said axis from the longitudinal centerline of said plate-like member for cooperation with said surface on said first keeper member to secure the first member to the second member; a further member adapted to be connected to the same side of the pivoted first member as said plate-like member is adapted to be connected and extend beyond an end of the first member and having an aperture in its extending end; and a second keeper member adapted to be secured to a part of the second member adjacent to an end of the first member when in secured position to project from the second member and to be received in said apertures in said elongated plate-like member and said further member to prevent relative movement between the first and second members in the plane of the first member.

* * * * *

UNITED STATES PATENT AND TRADEMARK OFFICE

CERTIFICATE OF CORRECTION

PATENT NO. 4,146,257

DATED March 27, 1979

INVENTOR(S) : JOHN V. PASTVA

It is certified that error appears in the above-identified patent and that said Letters Patent are hereby corrected as shown below:

Column 7, line 43, "pivioted" should be --pivoted--.

Column 8, line 55, "a" should be --the--.

Column 11, line 4, "remoted" should be --remote--.
line 5, "last" should be --least--.
Line 29, "adjavent" should be --adjacent--.
line 33, "pivot" should be --pivoted--.

Signed and Sealed this

*Thirty-first* Day of *July 1979*

[SEAL]

*Attest:*

*Attesting Officer*

LUTRELLE F. PARKER

*Acting Commissioner of Patents and Trademarks*